US009439467B2

(12) United States Patent
Stiff et al.

(10) Patent No.: US 9,439,467 B2
(45) Date of Patent: Sep. 13, 2016

(54) ACCESSORY STRUCTURES FOR CONNECTION BETWEEN STRAPS AND RELATED METHODS

(75) Inventors: Donald C. Stiff, Park City, UT (US); Peter M. Kelly, Park City, UT (US); Zack Leader, Park City, UT (US); David George Vogt, Jr., Salt Lake City, UT (US)

(73) Assignee: SKULLCANDY, INC., Park City, UT (US)

( * ) Notice: Subject to any disclaimer, the term of this patent is extended or adjusted under 35 U.S.C. 154(b) by 181 days.

(21) Appl. No.: 13/523,480

(22) Filed: Jun. 14, 2012

(65) Prior Publication Data

US 2013/0185905 A1 Jul. 25, 2013

Related U.S. Application Data

(63) Continuation-in-part of application No. 29/411,649, filed on Jan. 24, 2012, now Pat. No. Des. 676,023, and a continuation-in-part of application No. 29/411,650, filed on Jan. 24, 2012, now Pat. No. Des. 676,024.

(51) Int. Cl.
*A42B 3/04* (2006.01)
*A42B 3/30* (2006.01)

(52) U.S. Cl.
CPC . *A42B 3/04* (2013.01); *A42B 3/30* (2013.01); *Y10T 24/45* (2015.01); *Y10T 29/49* (2015.01); *Y10T 29/49826* (2015.01)

(58) Field of Classification Search
CPC ..... A45F 5/02; A45F 5/21; A45F 5/00; F16G 11/12; A47C 21/022; D06F 55/00; A42B 3/08; A42B 3/04; A42B 3/166; A42B 3/222; A42B 3/30; A42B 3/0406; A41F 9/002
USPC ..... 24/3.1, 3.7, 3.9, 3.11, 3.12, 129 B, 457, 24/545, 570; 2/421, 422, 423, 424, 321, 2/322
See application file for complete search history.

(56) References Cited

U.S. PATENT DOCUMENTS 1,329,029 A * 1/1920 Timmons ..... 379/430
4,320,863 A * 3/1982 Lyer et al. ..... 224/259
4,648,131 A * 3/1987 Kawaguchi et al. ..... 398/127
(Continued)

FOREIGN PATENT DOCUMENTS

CA 2515558 A1 2/2007
CA 2697029 A1 2/2007
(Continued)

*Primary Examiner* — Abigail Morrell
(74) *Attorney, Agent, or Firm* — TraskBritt

(57) ABSTRACT

Accessory structures for connection to straps of user-wearable accessories include a module, a first strap engagement structure disposed on a first side of the module, and a second strap engagement structure disposed on a second side of the module. The module may comprise at least one of an integral accessory device and an attachment feature configured for attachment to a separate accessory device. The strap engagement structures are configured for connection to straps of a user-wearable accessory. User-wearable accessory systems include such an accessory structure and a user-wearable accessory to which the accessory structure may be connected. Methods include the formation of such an accessory structure. Additional methods include the connection of such an accessory structure to a user-wearable accessory.

10 Claims, 9 Drawing Sheets

(56) References Cited

U.S. PATENT DOCUMENTS

| | | | | |
|---|---|---|---|---|
| 4,764,962 | A * | 8/1988 | Ekman et al. | 381/301 |
| 5,489,075 | A * | 2/1996 | Ible | 248/104 |
| 5,653,367 | A * | 8/1997 | Abramson | 224/581 |
| D384,200 | S * | 9/1997 | Caldwell | D3/218 |
| 5,915,609 | A * | 6/1999 | Diakoulas | 224/626 |
| 5,935,044 | A * | 8/1999 | Brewster | 450/86 |
| 6,019,335 | A * | 2/2000 | Sehati | 248/312 |
| 6,157,298 | A * | 12/2000 | Garfinkel et al. | 340/479 |
| 6,575,587 | B2 * | 6/2003 | Cramer et al. | 362/105 |
| 6,711,751 | B1 * | 3/2004 | Muskovitz | 2/410 |
| 6,999,732 | B2 * | 2/2006 | Fukuda et al. | 455/100 |
| 7,187,948 | B2 | 3/2007 | Alden | |
| 7,210,605 | B2 * | 5/2007 | Willows et | 224/637 |
| 7,395,090 | B2 | 7/2008 | Alden | |
| D623,627 | S | 9/2010 | Alden et al. | |
| D624,057 | S | 9/2010 | Kelly et al. | |
| D641,003 | S | 7/2011 | Alden | |
| 8,014,824 | B2 | 9/2011 | Alden | |
| D650,356 | S | 12/2011 | Alden et al. | |
| 8,079,501 | B2 | 12/2011 | Woodman | |
| D656,129 | S | 3/2012 | Kelly et al. | |
| D665,776 | S | 8/2012 | Alden et al. | |
| D665,777 | S | 8/2012 | Alden et al. | |
| D673,136 | S | 12/2012 | Kelly et al. | |
| D673,140 | S | 12/2012 | Kelly et al. | |
| D674,372 | S | 1/2013 | Kelly et al. | |
| D674,376 | S | 1/2013 | Kelly et al. | |
| D676,023 | S | 2/2013 | Kelly et al. | |
| D676,024 | S | 2/2013 | Kelly et al. | |
| D677,241 | S | 3/2013 | Kelly et al. | |
| D683,717 | S | 6/2013 | Kelly et al. | |
| 8,457,557 | B2 | 6/2013 | Alden | |
| D685,759 | S | 7/2013 | Kelly et al. | |
| D685,767 | S | 7/2013 | Kelly et al. | |
| 8,515,115 | B2 | 8/2013 | Kelly et al. | |
| D689,464 | S | 9/2013 | Bonahoom et al. | |
| D691,582 | S | 10/2013 | Nguyen et al. | |
| D693,793 | S | 11/2013 | Kelly et al. | |
| D699,216 | S | 2/2014 | Bonahoom et al. | |
| D701,193 | S | 3/2014 | Kelly et al. | |
| D701,196 | S | 3/2014 | Kelly et al. | |
| D701,197 | S | 3/2014 | Kelly et al. | |
| 2006/0179537 | A1 * | 8/2006 | Dennis et al. | 2/6.6 |
| 2010/0327030 | A1 * | 12/2010 | Yang | 224/199 |
| 2011/0034217 | A1 * | 2/2011 | Kushnirov | 455/569.1 |
| 2011/0235819 | A1 | 9/2011 | Alden | |
| 2012/0275615 | A1 | 11/2012 | Kelly et al. | |
| 2013/0118944 | A1 | 5/2013 | Niiro et al. | |
| 2013/0130540 | A1 | 5/2013 | Oman et al. | |
| 2013/0177165 | A1 | 7/2013 | Oishi | |
| 2013/0177195 | A1 | 7/2013 | Sze et al. | |
| 2013/0185905 | A1 | 7/2013 | Stiff et al. | |
| 2013/0208909 | A1 | 8/2013 | Mülder | |
| 2013/0288596 | A1 * | 10/2013 | Suzuki | B63C 11/26 455/40 |
| 2013/0336514 | A1 | 12/2013 | Kelly et al. | |
| 2014/0056459 | A1 | 2/2014 | Oishi et al. | |

FOREIGN PATENT DOCUMENTS

| | | | |
|---|---|---|---|
| EP | 1760896 | A1 | 3/2007 |
| EP | 2262117 | A1 | 12/2010 |
| WO | 2010068495 | A2 | 6/2010 |
| WO | 2010124190 | A2 | 10/2010 |
| WO | 2011085096 | A2 | 7/2011 |
| WO | 2012024656 | A2 | 2/2012 |

* cited by examiner

ACCESSORY STRUCTURES FOR CONNECTION BETWEEN STRAPS AND RELATED METHODS

CROSS-REFERENCE TO RELATED APPLICATIONS

This application is a continuation-in-part of U.S. Design patent application Ser. No. 29/411,649, filed Jan. 24, 2012, now U.S. Design Pat. D676,023 S, issued Feb. 12, 2013, and a continuation-in-part of U.S. Design patent application Ser. No. 29/411,650, filed Jan. 24, 2012, now U.S. Design Pat. D676,024 S, issued Feb. 12, 2013, the disclosure of each of which is incorporated herein in its entirety by this reference.

FIELD

The disclosure relates generally to accessory structures for connection in spaces between straps of a user-wearable accessory (e.g., a helmet, a shoulder pack, a backpack, etc.). More specifically, disclosed embodiments relate to accessory structures that carry an accessory device, or that may enable a user to attach an accessory device to a user-wearable accessory.

BACKGROUND

Those who wear user-wearable accessories, such as helmets, shoulder packs, and backpacks, may attach other devices to the exterior of those user-wearable accessories. However, attaching such devices to the user-wearable accessories may require modification of the user-wearable accessories, may require inconvenient and potentially insecure mounting accessories, or may require users to wear user-wearable accessories that the users would not normally wear.

BRIEF SUMMARY

In some embodiments, the present disclosure includes accessory structures for connection to straps of a user-wearable accessory. The accessory structures may comprise a module. The module may comprise a first strap engagement structure disposed on a first side of the module. The first strap engagement structure may be configured for connection to a first strap of a user-wearable accessory and may comprise a first surface configured to extend adjacent to and contact a section of the first strap and a first strap retention member configured to retain the section of the first strap adjacent the first elongated surface. The module may further comprise a second strap engagement structure disposed on a second side of the module. The second strap engagement structure may be configured for connection to a second strap of the user-wearable accessory and may comprise a second surface configured to extend adjacent to and contact a section of the second strap and a second strap retention member configured to retain the section of the second strap adjacent the second surface.

In additional embodiments, the present disclosure includes user-wearable accessory systems. The user-wearable accessory systems may comprise a user-wearable accessory comprising two straps oriented at an angle to one another and defining a wedge-shaped gap between the two straps and an accessory structure configured for connection to the two straps of the user-wearable accessory. The accessory structure may comprise a module. The module may comprise a first strap engagement structure disposed on a first side of the module. The first strap engagement structure may be configured for connection to a first strap of the two straps and may comprise a first surface configured to extend adjacent to and contact a section of the first strap and a first strap retention member configured to retain the section of the first strap adjacent the first surface. The module may further comprise a second strap engagement structure disposed on a second side of the module. The second strap engagement structure may be configured for connection to a second strap of the two straps and may comprise a second surface configured to extend adjacent to and contact a section of the second strap and a second strap retention member configured to retain the section of the second strap adjacent the second surface.

In yet further embodiments, the present disclosure includes methods of forming accessory structures for connection to straps of a user-wearable accessory. The methods may comprise forming a module. A first strap engagement structure disposed on a first side of the module may be formed and the first strap engagement structure may be configured for connection to a first strap of the user-wearable accessory. The first strap engagement structure may comprise a first surface configured to extend adjacent to and contact a section of the first strap and a first strap retention member configured to retain the section of the first strap adjacent the first surface. A second strap engagement structure disposed on a second side of the module may be formed and the second strap engagement structure may be configured for connection to a second strap of the user-wearable accessory. The second strap engagement structure may comprise a second surface configured to extend adjacent to and contact a section of the second strap and a second strap retention member configured to retain the section of the second strap adjacent the second surface.

Additional embodiments of the present disclosure include methods of connecting accessory structures to a user-wearable accessory. The methods may comprise disposing a module in a wedge-shaped gap between two straps of the user-wearable accessory. A first surface of a first strap engagement structure may be contacted with a section of a first strap of the two straps and the section of the first strap may be retained in contact with the first surface using a first strap retention member. A second surface of a second strap engagement structure may be contacted with a section of a second strap of the two straps and retaining the section of the second strap in contact with the second surface using a second strap retention member.

BRIEF DESCRIPTION OF THE DRAWINGS

While the disclosure concludes with claims particularly pointing out and distinctly claiming embodiments encompassed by the disclosure, various features and advantages of embodiments encompassed by the disclosure may be more readily ascertained from the following description when read in conjunction with the accompanying drawings, in which:

DETAILED DESCRIPTION

The illustrations presented herein are not meant to be actual views of any particular accessory structure, accessory device, user-wearable accessory, or component thereof, but are merely idealized representations employed to describe illustrative embodiments. Thus, the drawings are not necessarily to scale. Additionally, elements common between figures may retain the same or similar numerical designation.

Disclosed embodiments relate generally to accessory structures that may enable a user to connect an accessory device to a user-wearable accessory. More specifically, disclosed are accessory structures that may be attachable to user-wearable accessories using two engagement structures on sides of the accessory structure which may interface with two straps of the user-wearable accessories.

Figure 1:
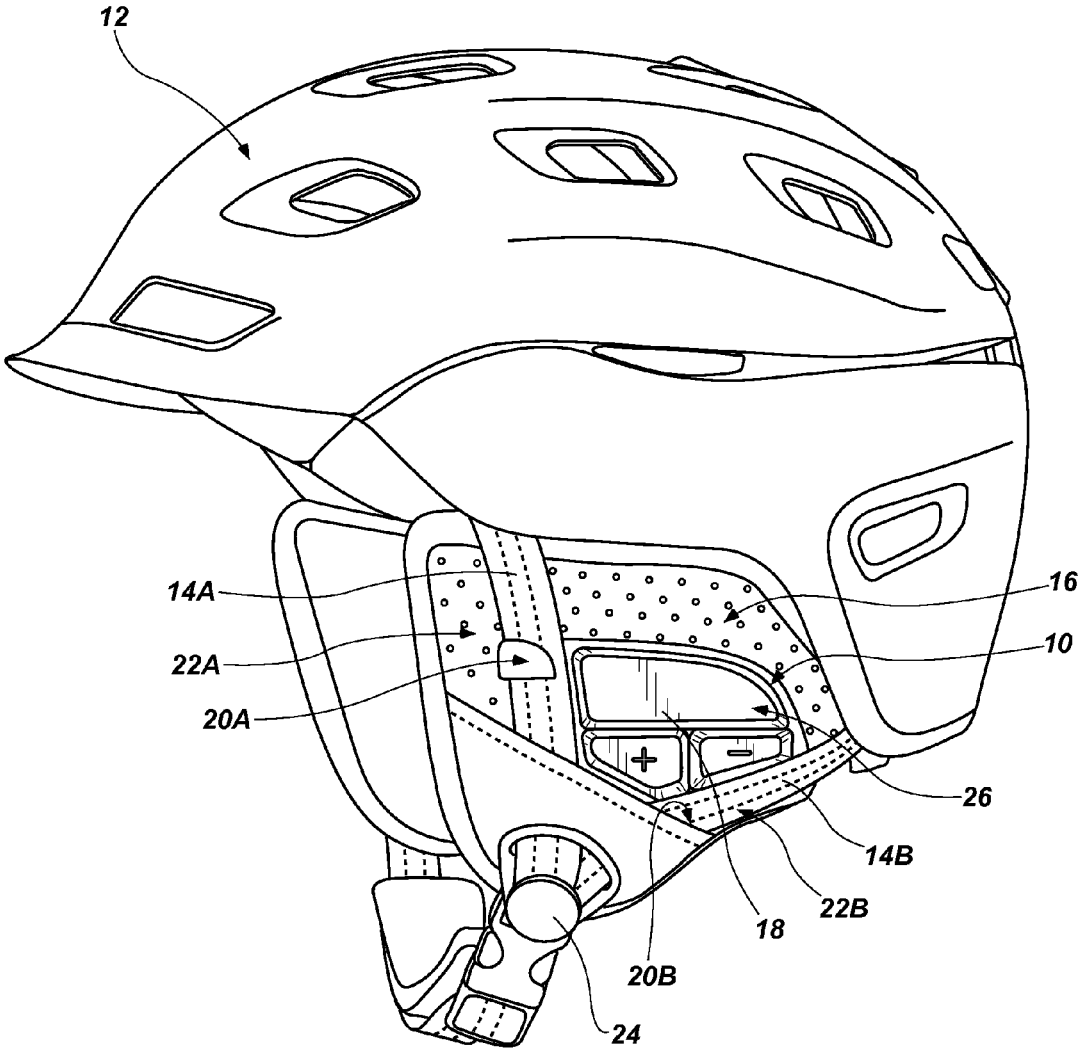
FIG. 1 is a perspective view of an accessory structure attached to a user-wearable accessory.

Referring to FIG. 1, a perspective view of an accessory structure 10 attached to a user-wearable accessory 12 is shown. The user-wearable accessory 12 includes two straps 14A and 14B that define a gap 16 (e.g., a space) between the two straps 14A and 14B. The accessory structure 10 comprises a module 18 positioned in the gap 16 between the straps 14A and 14B and two strap engagement structures 20A and 20B (one of which, strap engagement structure 20B, is depicted as being obscured by features of the user-wearable accessory 12 in FIG. 1) extending along sides 22A and 22B of the module 18 that are shaped and configured to interface with respective straps 14A and 14B to connect (e.g., to attach) the accessory structure 10 to the user-wearable accessory 12.

The user-wearable accessory 12 may comprise, for example, a helmet (e.g., a ski and snowboard helmet, a mountaineering helmet, a cycling helmet, a skate helmet, etc.), a backpack (e.g., an internal frame backpack, an external frame backpack, a frameless backpack, etc.), a shoulder pack (e.g., a messenger bag, a laptop bag, etc.), or other wearable article that may be worn by a user. In some embodiments, the straps 14A and 14B may extend from a body of the user-wearable accessory 12 and converge at an adjustable connector 24 to form a wedge-shaped gap 16 between the straps 14A and 14B. In other embodiments, the straps 14A and 14B may not converge with one another.

The accessory structure 10 may comprise an accessory device 26 that is integrally formed or otherwise attached to the module 18, mounting structures 46 (see FIG. 9) to which an accessory device 26 may be attached, or both, to expose the accessory device 26 for use by a user when wearing the user-wearable accessory 12. The accessory device 26 may comprise, for example, at least one of a controller for sending signals (e.g., control commands, audio signals, video signals, voice commands, etc.) to and receive signals (e.g., audio signals, video signals, etc.) from another device (e.g., a BLUETOOTH® controller), a microphone, a speaker, an audio jack, a screen (e.g., an LCD screen, an LED screen, an OLED screen, etc.), a light, and a camera. As a specific, non-limiting example, the accessory device 26 may comprise a BLUETOOTH® controller integral to the module 18 and configured to send and receive signals from a media player (e.g., a digital music player, a smartphone, a tablet computer, etc.), a microphone 36 (see FIG. 3) integral to the module 18 and connected to the controller, and speakers separate from the module 18 connected to an audio jack 38 (see FIG. 3) integral to the module 18. The accessory structure 10 may enable a user to, for example, interact with another device that is not directly accessible by the user (e.g., a smartphone concealed in a coat or backpack), control another device that is not directly controllable by the user (e.g., because gloves or other equipment inhibit interaction with the device), and expose accessory devices 26 to create media (e.g., to record hands-free video and audio) or communicate using a phone or other communication device. The strap engagement structures 20A and 20B may enable a user to retrofit existing user-wearable accessories 12 with the accessory structure 10 without requiring modification of the user-wearable accessories 12.

Figure 2:
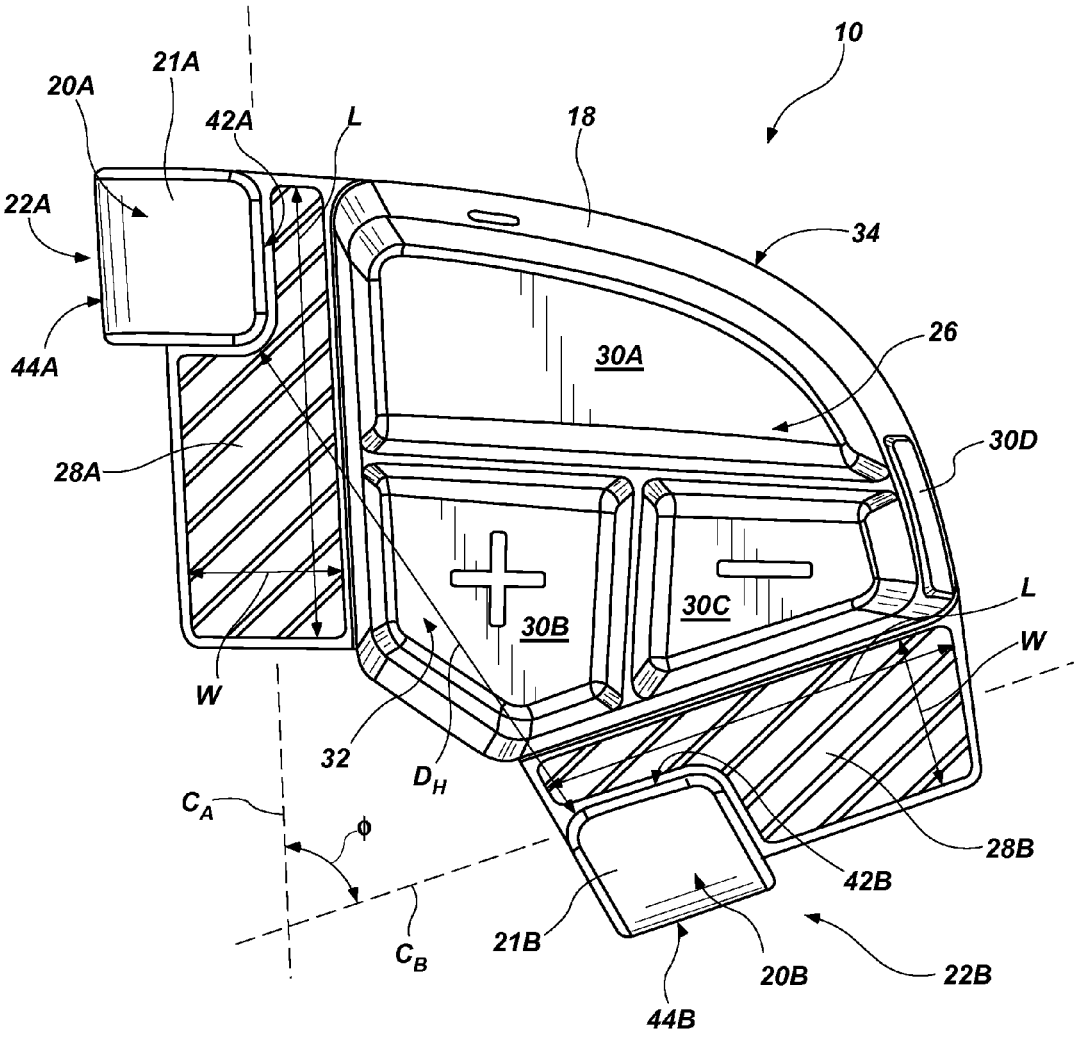
FIG. 2 is a front view of the accessory structure of FIG. 1.

Referring to FIG. 2, a front view of the accessory structure 10 of FIG. 1 is shown. Each strap engagement structure 20A and 20B may comprise a surface 28A or 28B (e.g., an elongated surface 28A or 28B) along which a section of a strap 14A or 14B (see FIG. 1) is configured to extend and which is contacted by the section of strap 14A or 14B (see FIG. 1) when it is engaged with the strap engagement structure 20A or 20B. Each surface 28A and 28B may comprise a grip pad or grip pads of a high-friction material (e.g., rubber, silicone) on the surface 28A and 28B. In other embodiments, the engagement structures 20A and 20B may comprise protrusions, hook-and-loop attachment features (e.g., VELCRO®), adhesives or the like to further restrict relative movement between the straps 14A and 14B and the engagement structures 20A and 20B, respectively, although some relative movement may be permitted in some embodiments. Each surface 28A and 28B may be configured to be at least substantially the same width as the strap 14A or 14B to which the accessory structure 10 is intended to be connected and may extend for a significant length that the sections of straps 14A and 14B may contact. For example, a width W of each surface 28A and 28B may be between about 1 in (2.54 cm) and about ⅛ in (0.32 cm) and a length L covered by each surface 28A and 28B may be between about 3 in (7.62 cm) and about 1 in (2.54 cm).

Each strap engagement structure 20A and 20B may further comprise a strap retention member 21A or 21B configured to retain the strap 14A or 14B interfaced with the strap engagement structure 20A or 20B. Each strap retention member 21A and 21B may comprise, for example, a hook, a clip, a clamp, etc. Each strap retention member 21A and 21B may comprise a portion extending over at least a portion of a respective surface 28A or 28B. Each strap retention member 21A and 21B may comprise an opening 42A and 42B through which a strap 14A or 14B may be inserted and a delimiting portion 44A and 44B which may impede the strap 14A or 14B from involuntarily disengaging from the strap engagement structure 20A or 20B. Each delimiting portion 44A and 44B may comprise, for example, a bend section of a hook, a clip, a clamp, etc.

In some embodiments wherein the surfaces 28A and 28B comprise grip pads, the grip pads may not extend under the strap engagement structures 20A and 20B. In other embodiments, the grip pads of the surfaces 28A and 28B may extend under the strap engagement structures 20A and 20B. The grip pads of the surfaces 28A and 28B may enable the accessory structure 10 to remain in substantially the same position after connection to a user-wearable accessory 12

(see FIG. 1), though some relative movement between the accessory structure 10 and the user-wearable accessory 12 (see FIG. 1) may be permitted in some embodiments.

The module 18 may define a generally wedge-like shape, which may at least substantially conform to the wedge shape of the gap 16 (see FIG. 1) into which the module 18 is intended to be positioned. For example, the sides 22A and 22B at which the strap engagement structures 20A and 20B are located may extend at oblique angles to one another. As another example, centerlines $C_A$ and $C_B$ extending along centers of the surfaces 28A and 28B of the strap engagement structures 20A and 20B may converge with one another to define an angle Φ between the centerlines $C_A$ and $C_B$. For example, the angle Φ defined between the centerlines $C_A$ and $C_B$ of the surfaces 28A and 28B of the strap engagement structures 20A and 20B may be between about 90° and about 30°, between about 85° and about 45°, or between about 80° and about 50°. More specifically, the angle Φ defined between the centerlines $C_A$ and $C_B$ of the surfaces 28A and 28B of the strap engagement structures 20A and 20B may be between about 75° and about 55°.

The strap retention members 21A and 21B may extend from a single face 32 of the module 18 in some embodiments. For example, the strap retention members 21A and 21B may extend from a front face 32 of the module 18 configured to face away from a user when the accessory structure 10 is connected to a user-wearable accessory 12 (see FIG. 1) worn for normal use by the user. As another example, the strap retention members 21A and 21B may extend from a back face 34 of the module 18 that is configured to face toward a user when the accessory structure 10 is connected to a user-wearable accessory 12 (see FIG. 1) when worn by the user. In other embodiments, one of the strap retention members 21A or 21B may extend from one face 32 and the other of the strap retention members 21A or 21B may extend from the other face 34 of the module 18. In still other embodiments, the strap retention members 21A and 21B may be located on both faces 32 and 34 of the module 18 (i.e., each strap engagement structure 20A and 20B may comprise more than one strap retention member 21A or 21B).

Openings 42A and 42B of the strap retention members 21A and 21B into which the straps 14A and 14B (see FIG. 1) may be inserted may face one another in some embodiments. In other embodiments, the openings 42A and 42B may face in opposing directions. In still other embodiments, the openings 42A and 42B may face in the same direction, such as, for example, toward one of the two sides 22A and 22B of the accessory structure 10. The openings 42A and 42B of the strap retention members 21A and 21B may oppose delimiting portions 44A and 44B which the straps 14A and 14B may contact when fully inserted into the strap retention members 21A and 21B. In still other embodiments, the strap retention members 21A and 21B may be configured as closed structures that extend completely around the straps 14A and 14B and do not contain openings 42A or 42B. In these embodiments, the straps 14A and 14B may be threaded through the structure. Alternatively, the strap retention members 21A and 21B may be configured be movable between an open position wherein the openings 42A and 42B are temporarily formed, and a closed position where the openings 42A and 42B are substantially or completely eliminated. For example, the strap retention members 21A and 21B may comprise clips, snaps, hook-and-loop fasteners, or other closures to selectively form and close the openings 42A and 42B when connecting the accessory structure 10 to a user-wearable accessory 12 (see FIG. 1).

A shortest distance $D_H$ between the strap retention members 21A and 21B may be large enough to span the gap 16 between the straps 14A and 14B (see FIG. 1) in which the module 18 is intended to be disposed. For example, the shortest distance $D_H$ between the strap retention members 21A and 21B may be between about 5 in (12.7 cm) and about 1 in (2.54 cm). More specifically, the shortest distance $D_H$ between the strap retention members 21A and 21B may be between about 4 in (10.16 cm) and about 2 in (5.08 cm).

The accessory structure 10 may comprise buttons 30A, 30B, 30C, and 30D on the module 18 to enable a user to interact with the accessory device 26 through the module 18. Though an illustrative button configuration enabling illustrative functions is shown, it should be understood that the present embodiment is not limited to that button configuration and a myriad of button configurations is possible to enable a myriad of functions. For example, the accessory structure 10 may comprise a control button 30A, the selective pressing (e.g., single press, double press, triple press, press and hold) of which may enable a user to, for example, answer telephone calls, activate voice control, play, pause, and navigate tracks in an audio playlist, etc.; a volume increase button 30B, a volume decrease button 30C, the pressing of each of which may increase or decrease volume to speakers integral to the module 18 or external and connected to the module 18, and a power and pairing button 30D, the pressing of which may turn the accessory device 26 on and off, may enable the accessory device 26 to connect to another device (e.g., to connect wirelessly to a smartphone), or both. The buttons 30A, 30B, 30C, and 30D may be sufficiently large that they may be easily selected and pressed by a user wearing gloves (e.g., winter gloves). In some embodiments, the buttons 30A, 30B, 30C, and 30D may be at different elevations above the module 18. For example, the control button 30A may be raised higher above the module 18 than the volume increase and decrease buttons 30B and 30C and the power and pairing button 30D to enable a user to more easily distinguish between the buttons 30A, 30B, 30C, and 30D without looking at them. In some embodiments, the buttons 30A, 30B, 30C, and 30D may have different textures (e.g., different shapes formed in the surfaces of the buttons 30A, 30B, 30C, and 30D) to enable a user to more easily distinguish between the buttons 30A, 30B, 30C, and 30D by touch. In still other embodiments, the module 18 may comprise a capacitive or resistive touch panel that is configured to receive and transmit user inputs.

The module 18 and strap engagement structures 20A and 20B of the accessory structure 10 may be of a lightweight and durable material suitable for outdoor use. For example, the module 18 and strap engagement structures 20A and 20B may comprise thermoplastic polymers, thermoset polymers, or metals. The module 18 and strap engagement structures 20A and 20B may be made using manufacturing techniques known in the art for such materials, such as, for example, injection molding and machining.

Figure 3:
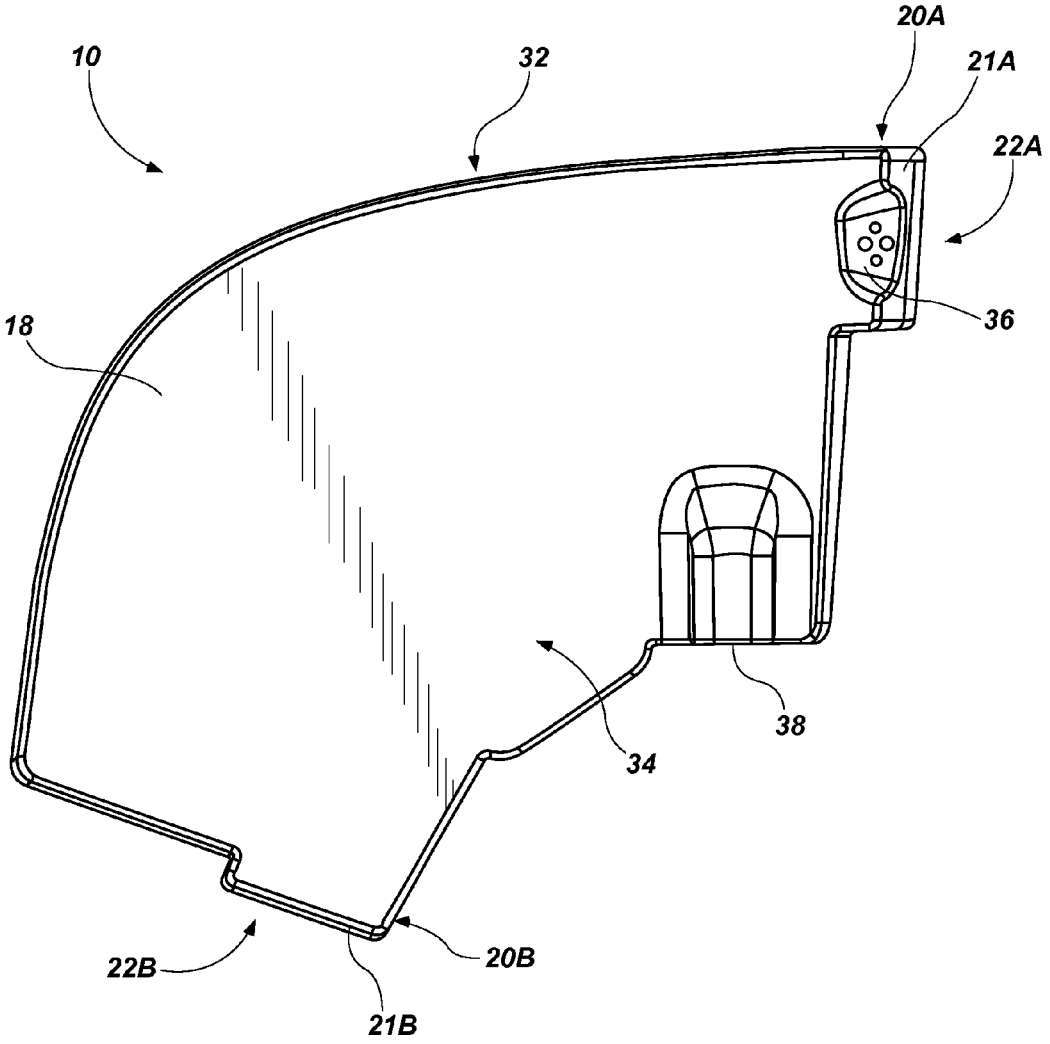
FIG. 3 is a rear view of the accessory structure of FIG. 1.

Referring to FIG. 3, a rear view of the accessory structure 10 of FIG. 1 is shown. In embodiments where the accessory device 26 includes a microphone 36, the microphone 36 may be located on the accessory structure 10 to be nearest a user's mouth or vocal cords when the accessory structure 10 is connected to a user-wearable accessory 12 (see FIG. 1) worn for normal use by the user. For example, the microphone 36 may be located on the back face 34 of the module 18 in a body of a strap retention member 21A. In embodiments where the accessory device 26 includes external speakers connected to the module 18, the module 18 may include an audio jack 38 (e.g., a tip sleeve (TS) connector, a tip ring sleeve (TRS) connector, or a tip ring ring sleeve (TRRS) connector) to which an audio plug extending from speaker units (e.g., headphones) may be connected. For example, the module 18 may include an audio jack 38 opening downwardly on the back face 34 of the module 18.

Figure 4:
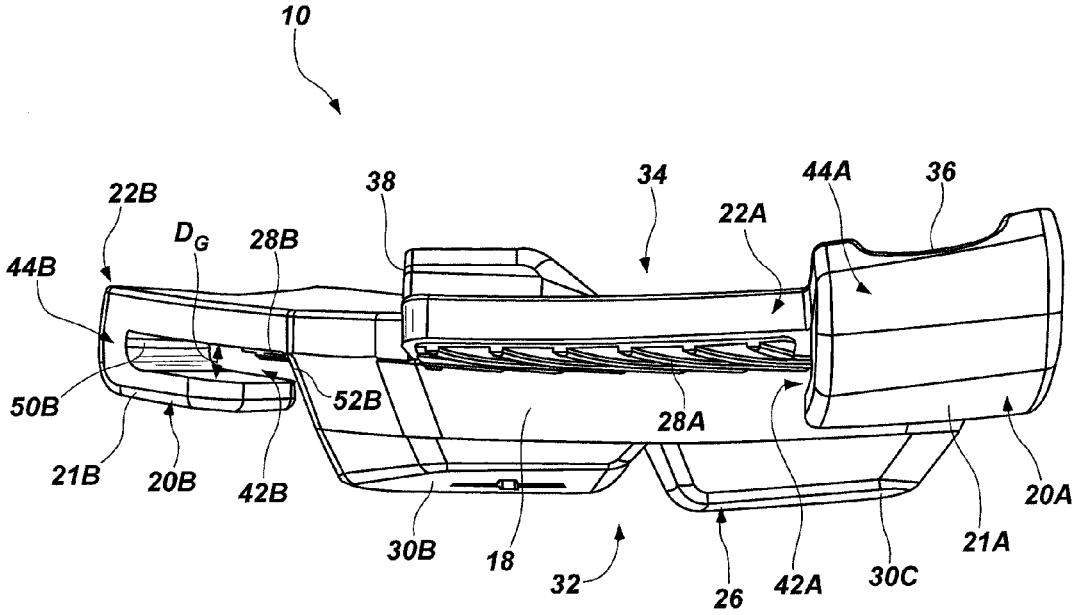
FIG. 4 is an end view of the accessory structure of FIG. 1.

Referring to FIG. 4, an end view of the accessory structure 10 of FIG. 1 is shown. Specifically the side 22A of the accessory structure 10 on which the microphone 36 is located is shown. Each strap retention member 21A and 21B may extend away from its respective surface 28A or 28B to define the opening 42A or 42B of the strap retention member 21A or 21B. A gap distance $D_G$ between each strap engagement structure 20A and 20B and the module 18 may be large enough to accommodate the straps 14A and 14B of the user-wearable accessory 12 (see FIG. 1) to which the accessory structure is intended to be connected. For example, the gap distance $D_G$ between each strap engagement structure 20A and 20B may be between about 1/32 in (0.79 mm) and about 1/4 in (6.35 mm).

Figure 7:
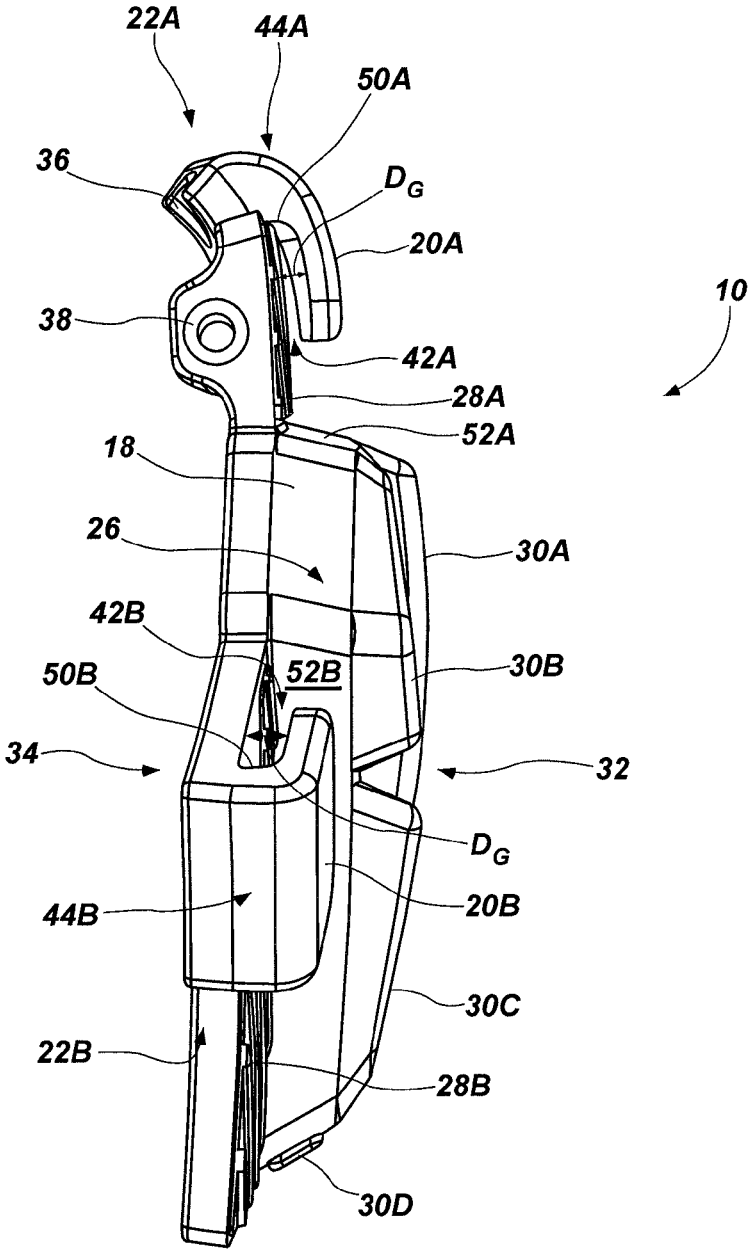
FIG. 7 is a bottom view of the accessory structure of FIG. 1.

With combined reference to FIGS. 4 and 7, The delimiting portion 44A or 44B of each strap retention member 21A and 21B may comprise a first lateral surface 50A or 50B (e.g., a first lateral boundary surface 50A or 50B) which may impede movement of a section of a strap 14A or 14B (see FIG. 1) toward one of the sides 22A or 22B of the accessory structure 10 once the section of the strap 14A or 14B is inserted into the strap engagement structure 20A or 20B. The module 18 may extend above the surface 28A or 28B of each strap engagement structure 20A and 20B which is configured to be contacted by the section of the strap 14A or 14B (see FIG. 1) to define a second, opposing lateral surface 52A or 52B (e.g., a second lateral boundary surface 52A or 52B) which may impede movement of a section of a strap 14A or 14B (see FIG. 1) toward the other of the sides 22A or 22B of the accessory structure 10 once the section of the strap 14A or 14B is inserted into the strap engagement structure 20A or 20B. Each strap engagement structure 20A and 20B and its corresponding surface 28A or 28B may impede movement of a section of a strap 14A or 14B (see FIG. 1) toward the faces 32 and 34 of the accessory structure 10 once the section of the strap 14A or 14B is inserted into the strap engagement structure 20A or 20B. In other words, the strap engagement structures 20A and 20B and the module 18 may cooperatively impede movement of the straps 14A and 14B (see FIG. 1) in four principal directions, which may significantly reduce the likelihood that the accessory structure 10 will accidentally become detached from the user-wearable accessory 12 (see FIG. 1).

Returning to FIG. 4, the volume increase button 30B may be elevated a different distance above the module 18 than a distance above the module 18 at which the volume decrease button 30C is elevated. In addition, the microphone 36 may be recessed into a body of a strap retention member 21A configured to be positioned nearest a user's mouth or vocal cords when the accessory structure 10 is connected to a user-wearable accessory 12 (see FIG. 1) worn by a user for normal use. The audio jack 38 may extend from a surface of the module 18 on the back face 34 of the accessory structure 10.

Figure 5:
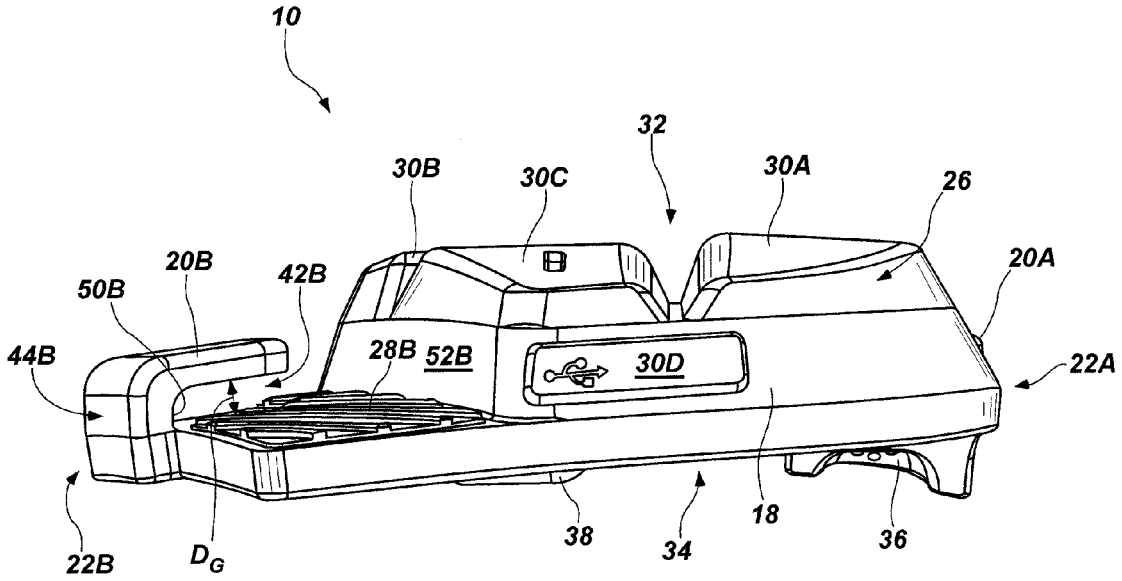
FIG. 5 is another, opposing end view of the accessory structure of FIG. 1.

Referring to FIG. 5, another, opposing end view of the accessory structure 10 of FIG. 1 is shown. Specifically, the side 22B of the accessory structure 10 opposing the side 22A on which the microphone 36 is located is shown. The power and pairing button 30D may be oriented in a different direction than the other buttons 30A, 30B, and 30C of the accessory structure 10, which may render the power and pairing button 30D more difficult for a user to press unintentionally, resulting in unwanted disconnection or powering off of the accessory device 26. For example, an upper surface of the power and pairing button 30D may be at least substantially perpendicular to upper surfaces of the other buttons 30A, 30B, and 30C.

Figure 6:
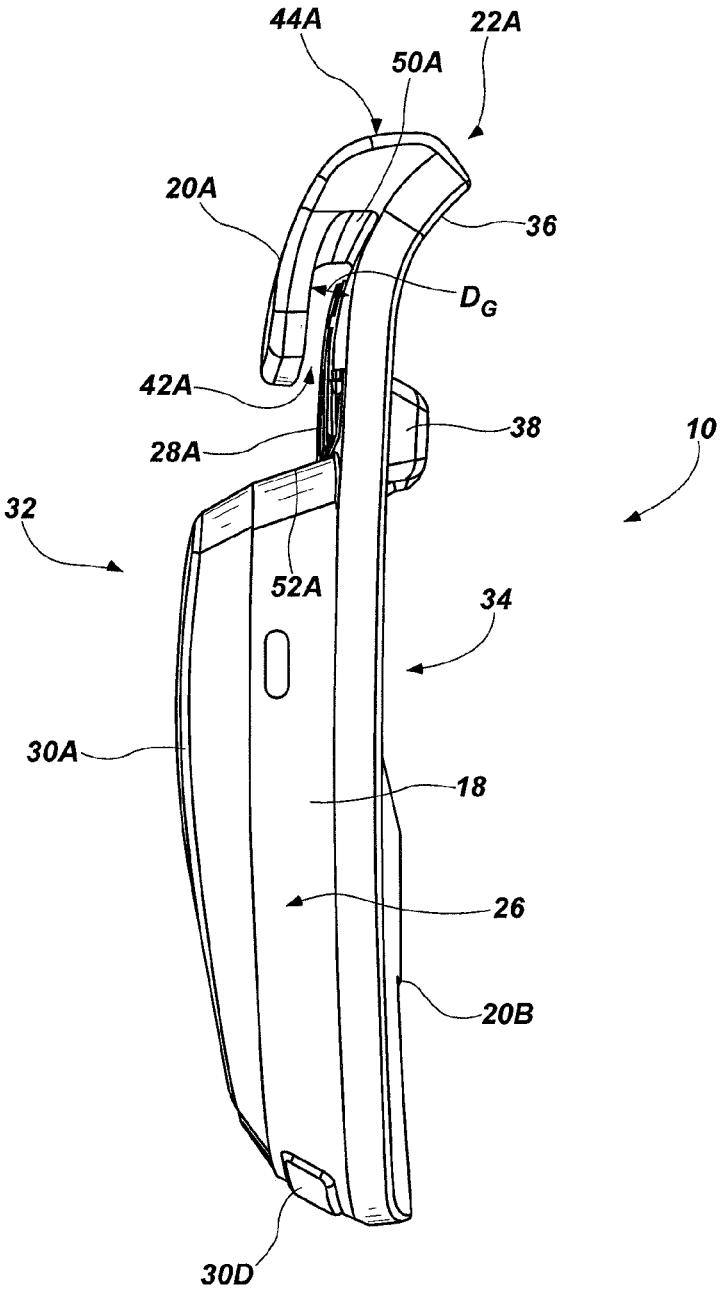
FIG. 6 is a top view of the accessory structure of FIG. 1.

Referring to FIG. 6, a top view of the accessory structure 10 of FIG. 1 is shown. The control button 30A may occupy a greater surface area on the module 18 than the other buttons 30B, 30C, and 30D, which may enable a user to more quickly find the control button 30A, which may be the button 30A most frequently pressed by the user.

Referring to FIG. 7, a bottom view of the accessory structure 10 of FIG. 1 is shown. Outermost surfaces of the opposing sides 22A and 22B of the accessory structure 10 may not extend in directions parallel to one another. For example, the outermost surfaces of the opposing sides 22A and 22B, which may define portions of the delimiting portions 44A and 44B of the strap engagement structures 20A and 20B, may extend in directions that are at least substantially similar to the directions in which the straps 14A and 14B (see FIG. 1) are intended to extend when connected to the accessory structure 10. In some embodiments, the outermost surfaces of the opposing sides 22A and 22B may extend in directions that are slightly different from the directions in which the straps 14A and 14B (see FIG. 1) are intended to extend when connected to the accessory structure 10.

Figure 8:
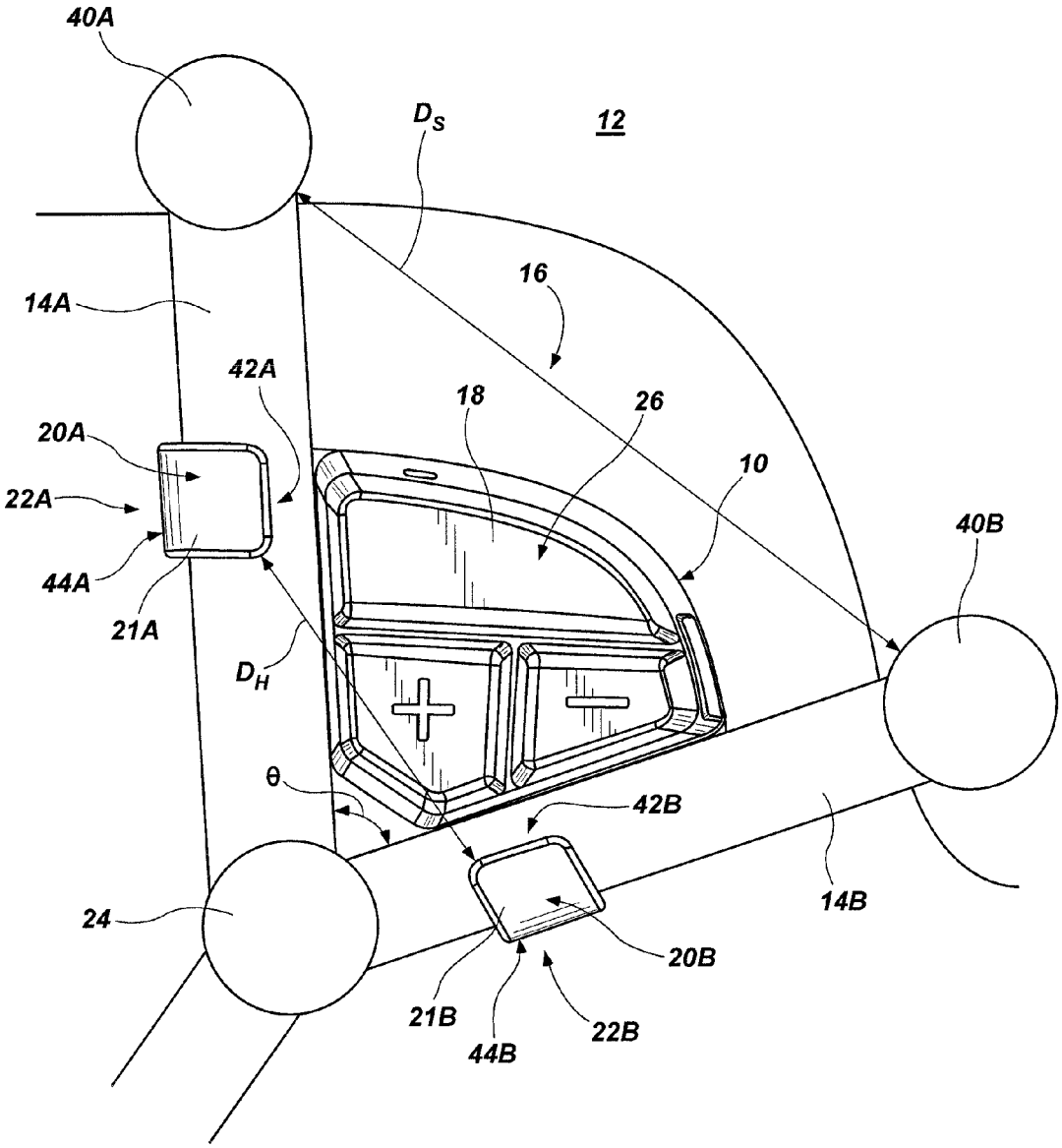
FIG. 8 is a simplified view of the accessory structure of FIG. 1 attached to straps and positioned in a gap between the straps.

Referring to FIG. 8, a simplified view of the accessory structure 10 of FIG. 1 connected to straps 14A and 14B and positioned in a gap 16 between the straps 14A and 14B is shown. The straps 14A and 14B may extend from fixed attachments 40A and 40B connecting them to the user-wearable accessory 12, through the strap engagement structures 20A and 20B securing the module 18 in the gap 16 between the straps 14A and 14B, to the adjustable connector 24 where the straps 14A and 14B converge with one another. The adjustable connector 24 may be movable down and away from the fixed attachments 40A and 40B and up and toward the fixed attachments 40A and 40B, which movement may modify the size of the gap 16 and the length of each strap 14A and 14B between its respective fixed attachment 40A or 40B and the adjustable connector 24.

A separation distance $D_S$ between the fixed attachments 40A and 40B may between about 7 in (17.78 cm) and about 3 in (7.62 cm). More specifically, the separation distance $D_S$ between the fixed attachments 40A and 40B may be between about 6 in (15.24 cm) and about 4 in (10.16 cm). As a specific, non-limiting example, the separation distance $D_S$ between the fixed attachments 40A and 40B may be about 5 in (12.7 cm). The separation distance $D_S$ may remain constant regardless of the position of the adjustable connector 24.

The shortest distance $D_H$ between the strap retention members 21A and 21B may be less than the separation distance $D_S$ between the fixed attachments 40A and 40B. For example, the shortest distance $D_H$ between the strap retention members 21A and 21B may be between about 6 in (15.24 cm) and about 1 in (2.54 cm) shorter than the separation distance $D_S$ between the fixed attachments 40A and 40B. More specifically, the shortest distance $D_H$ between the strap retention members 21A and 21B may be between about 3 in (7.62 cm) and about 2 in (5.08 cm) shorter than the separation distance $D_S$ between the fixed attachments 40A and 40B.

In some embodiments, tension in the straps 14A and 14B may hold the accessory structure 10 in place. For example, in embodiments where the openings 42A and 42B of the strap retention members 21A and 21B face toward one another, the adjustable connector 24 may be slid away from the fixed attachments 40A and 40B to increase the size of the gap 16 and move the straps 14A and 14B away from one another. Distance between the straps 14A and 14B may increase until the straps 14A and 14B are forced against the delimiting portions 44A and 44B of the strap retention members 21A and 21B. Tension in the straps 14A and 14B, which may tend to force them away from one another, may then hold the accessory structure 10 in place. As another example, in embodiments where the openings 42A and 42B of the strap retention members 21A and 21B face away from one another, the adjustable connector 24 may be slid toward the fixed attachments 40A and 40B to decrease the size of the gap 16 and move the straps 14A and 14B toward one another. Distance between the straps 14A and 14B may decrease until the straps 14A and 14B are forced against the delimiting portions 44A and 44B of the strap retention members 21A and 21B. Tension in the straps 14A and 14B, which may tend to force them toward one another, may then hold the accessory structure 10 in place.

A user wishing to increase the security of the connection between the accessory structure 10 and the user-wearable accessory 12 may interface the straps 14A and 14B with the strap engagement structures 20A and 20B and slide the adjustable connector 24 toward or away from the fixed attachments 40A and 40B until an angle θ defined between the straps 14A and 14B causes them to extend in a direction such that tension in the straps 14A and 14B forces them against the delimiting portions 44A and 44B in the strap retention members 21A and 21B. The angle θ defined between the straps 14A and 14B may be between about 85° and about 45°. More specifically, the angle θ defined between the straps 14A and 14B may be between about 75° and about 55°. As a specific, non-limiting example, the angle θ defined between the straps 14A and 14B may be about 65°. In some embodiments, the elongated surfaces 28A and 28B of the strap engagment structures 20A and 20B (FIG. 2) may extend at least substantially parallel to the straps 14A and 14B. For example, an angle defined between the elongated surfaces 28A and 28B of the strap engagment structures 20A and 20B (FIG. 2) may be at least substantially the same as the angle θ defined between the straps 14A and 14B (e.g., between about 85° and about 45°). After adjusting the adjustable connector 24, the user may then leave the adjustable connector 24 in place, and then either squeeze the straps 14A and 14B together or pull the straps 14A and 14B apart, align the straps 14A and 14B with the openings 42A and 42B of the strap retention members 21A and 21B, and release the straps 14A and 14B, which release may cause the straps 14A and 14B to engage with the strap engagement structures 20A and 20B and be forced against the delimiting portions 44A and 44B of the strap retention members 21A and 21B.

Figure 9:
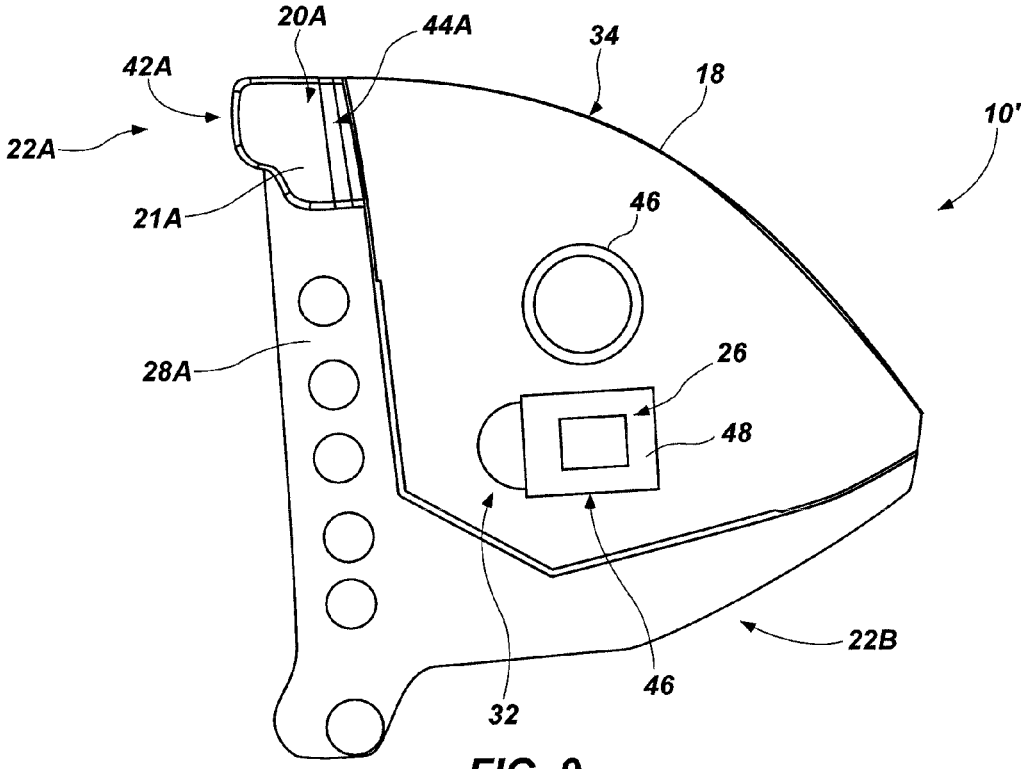
FIG. 9 is a front view of another embodiment of an accessory structure.

Referring to FIG. 9, a front view of another embodiment of an accessory structure 10' is shown. The accessory structure 10' may comprise mounting structures 46 (one of which is obscured by a light 48 attached to the module 18 using a mounting structure 46) integral to the module 18 to which other structures (e.g., accessory devices 26) may be attached. For example, the mounting structures 46 may comprise threaded bores with which threaded protrusions (e.g., screws) may engage, threaded protrusions with which threaded bores may engage, balls with which sockets may engage to form a joint, etc. As specific, non-limiting examples, the mounting structures 46 may comprise light, microphone, or camera mounts.

The accessory structure 10' may include a single strap retention member 21A on the front face 32 of the module 18. An opening 42A of the strap retention member 21A may face away from a center of the module 18 in some embodiments. In other embodiments, the opening 42A of the strap retention member 21A may face toward the center of the module 18

Figure 10:
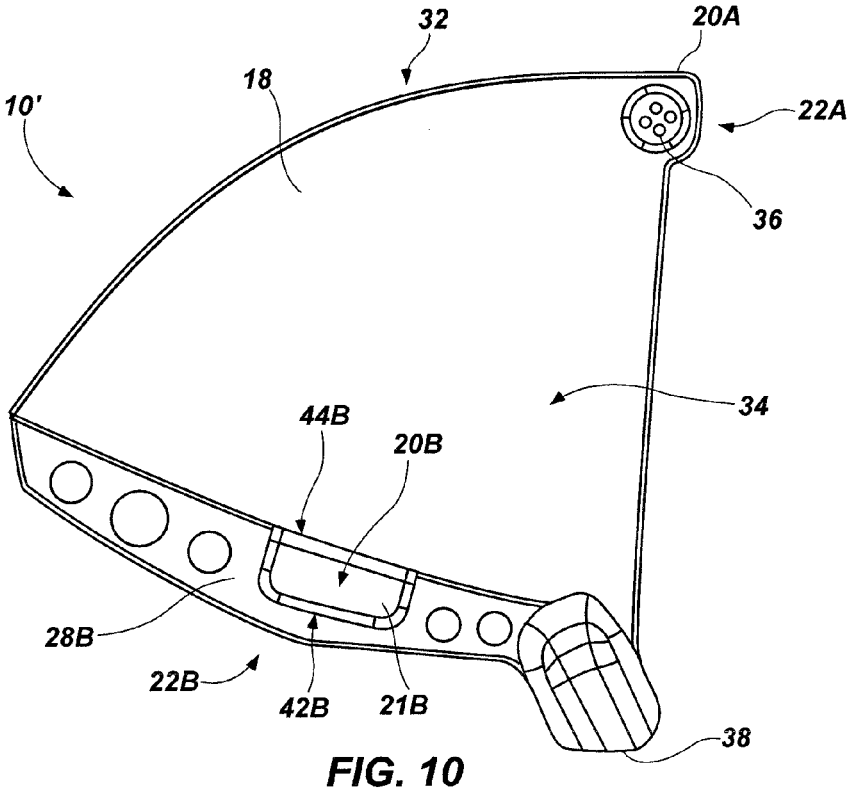
FIG. 10 is a rear view of the accessory structure of FIG. 9.

Referring to FIG. 10, a rear view of the accessory structure 10' of FIG. 9 is shown. The accessory structure 10' may comprise another strap retention member 21B on the back face 34 of the module 18. In other words, the strap retention members 21A (see FIG. 9) and 21B may be located on opposing faces 32 and 34 of the module 18. An opening 42B of the strap retention member 21B may face away from the opening 42A of the strap retention member 21A (see FIG. 9) on the front face 32 of the module 18. The opening 42B of the strap retention member 21B may face away from the center of the module 18 in some embodiments. In other embodiments, the opening 42B of the strap retention member 21B may face toward the center of the module 18.

Additional non-limiting example embodiments are described below.

Embodiment 1

An accessory structure for connection to straps of a user-wearable accessory, comprising: a module comprising: a first strap engagement structure disposed on a first side of the module, the first strap engagement structure configured for connection to a first strap of a user-wearable accessory, the first strap engagement structure comprising a first surface configured to extend adjacent to and contact a section of the first strap and a first strap retention member configured to retain the section of the first strap adjacent the first elongated surface; and a second strap engagement structure disposed on a second side of the module, the second strap engagement structure configured for connection to a second strap of the user-wearable accessory, the second strap engagement structure comprising a second surface configured to extend adjacent to and contact a section of the second strap and a second strap retention member configured to retain the section of the second strap adjacent the second surface.

Embodiment 2

The accessory structure of Embodiment 1, wherein the module further comprises an integral accessory device selected from the group consisting of a controller for another device, a speaker, a microphone, a light, and a camera.

Embodiment 3

The accessory structure of Embodiment 1 or Embodiment 2, wherein the module further comprises an attachment feature configured for attachment to a separate accessory device.

Embodiment 4

The accessory structure of any one of Embodiments 1 through 3, wherein a shortest distance between the first strap retention member and the second strap retention member is between about 4 in (10.16 cm) and about 2 in (5.08 cm).

Embodiment 5

The accessory structure of any one of Embodiments 1 through 4, wherein the first strap retention member comprises a portion extending over at least a portion of the first surface, and wherein the second strap retention member comprises a portion extending over at least a portion of the second surface.

Embodiment 6

The accessory structure of any one of Embodiments 1 through 5, wherein the accessory structure is configured for connection to the section of the first strap and the section of the second strap when the section of the first strap and the section of the second strap are oriented at an angle greater than zero to one another.

Embodiment 7

The accessory structure of any one of Embodiments 1 through 6, wherein the module is configured to be located in a wedge-shaped space between the section of the first strap and the section of the second strap when the first strap engagement structure is engaged with the section of the first strap and the second strap engagement structure is engaged with the section of the second strap.

Embodiment 8

The accessory structure of any one of Embodiments 1 through 7, wherein a centerline of the first surface of the first strap engagement structure is oriented at an angle greater than zero to a centerline of the second surface of the second strap engagement structure.

Embodiment 9

The accessory structure of Embodiment 8, wherein the module further comprises a laterally extending surface extending above the first surface of the first strap engagement structure and the second surface of the second strap engagement structure to impede movement of the accessory structure relative to the section of the first strap and the section of the second strap when the first strap engagement structure is engaged with the section of the first strap and the second strap engagement structure is engaged with the section of the second strap.

Embodiment 10

The accessory structure of Embodiment 9, wherein the angle between the longitudinal centerline of the first surface and the longitudinal centerline of the second surface is between about 45° and about 85°.

Embodiment 11

The accessory structure of any one of Embodiments 1 through 10, wherein the angle between the longitudinal centerline of the first surface and the longitudinal centerline of the second surface is between about 75° and about 55°.

Embodiment 12

A user-wearable accessory system, comprising: a user-wearable accessory comprising two straps oriented at an angle to one another and defining a wedge-shaped gap between the two straps; and an accessory structure configured for connection to the two straps of the user-wearable accessory, the accessory structure comprising: a module comprising: a first strap engagement structure disposed on a first side of the module, the first strap engagement structure configured for connection to a first strap of the two straps, the first strap engagement structure comprising a first surface configured to extend adjacent to and contact a section of the first strap and a first strap retention member configured to retain the section of the first strap adjacent the first surface; and a second strap engagement structure disposed on a second side of the module, the second strap engagement structure configured for connection to a second strap of the two straps, the second strap engagement structure comprising a second surface configured to extend adjacent to and contact a section of the second strap and a second strap retention member configured to retain the section of the second strap adjacent the second surface.

Embodiment 13

The system of Embodiment 12, wherein the first strap and the second strap extend from different fixed attachment locations on the user-wearable accessory and converge with one another at an adjustable connector.

Embodiment 14

The system of Embodiment 12 or Embodiment 13, wherein the first strap is placed in tension against the first strap retention member and the second strap is placed in tension against the second strap retention member when the accessory structure is connected to the two straps of the user-wearable accessory.

Embodiment 15

A method of forming an accessory structure for connection to straps of a user-wearable accessory, comprising: forming a module; forming a first strap engagement structure disposed on a first side of the module and configuring the first strap engagement structure for connection to a first strap of the user-wearable accessory, the first strap engagement structure comprising a first surface configured to extend adjacent to and contact a section of the first strap and a first strap retention member configured to retain the section of the first strap adjacent the first surface; and forming a second strap engagement structure disposed on a second side of the module and configuring the second strap engagement structure for connection to a second strap of the user-wearable accessory, the second strap engagement structure comprising a second surface configured to extend adjacent to and contact a section of the second strap and a second strap retention member configured to retain the section of the second strap adjacent the second surface.

Embodiment 16

The method of Embodiment 15, wherein forming the module comprises forming the module to comprise an attachment feature for an accessory device selected from the group consisting of a controller for another device, a speaker, a microphone, a light, and a camera.

Embodiment 17

The method of Embodiment 15 or Embodiment 16, further comprising locating the second strap retention member a distance of between about 4 in (10.16 cm) and about 2 in (5.08 cm) from the first strap retention member.

Embodiment 18

The method of any one of Embodiments 15 through 17, further comprising orienting the first surface and the second surface such that an angle between a centerline of the first surface and a centerline of the second surface is between about 90° and about 45°.

Embodiment 19

The method of any one of Embodiments 15 through 18, further comprising forming the module to include a laterally extending surface extending above the first surface and the second surface to impede relative movement between the accessory structure and the straps of the user-wearable accessory.

Embodiment 20

A method of connecting an accessory structure to a user-wearable accessory, comprising: disposing a module in a wedge-shaped gap between two straps of the user-wearable accessory; contacting a first surface of a first strap engagement structure with a section of a first strap of the two straps and retaining the section of the first strap in contact with the first surface using a first strap retention member; and contacting a second surface of a second strap engagement structure with a section of a second strap of the two straps and retaining the section of the second strap in contact with the second surface using a second strap retention member.

Embodiment 21

The method of Embodiment 20, wherein retaining the section of the first strap in contact with the first surface using the first strap retention member comprises disposing the section of the first strap between the first surface and the first strap retention member, and wherein retaining the section of the second strap in contact with the second surface using the second strap retention member comprises disposing the section of the second strap between the second surface and the second strap retention member.

Embodiment 22

The method of Embodiment 20 or Embodiment 21, further comprising impeding relative movement between the accessory structure and the two straps of the user-wearable accessory using a laterally extending surface of the module extending above the first surface and the second surface.

While certain illustrative embodiments have been described in connection with the figures, those of ordinary skill in the art will recognize and appreciate that embodiments encompassed by the disclosure are not limited to those embodiments explicitly shown and described herein. Rather, many additions, deletions, and modifications to the embodiments described herein may be made without departing from the scope of embodiments encompassed by the disclosure, such as those hereinafter claimed, including legal equivalents. In addition, features from one disclosed embodiment may be combined with features of another disclosed embodiment while still being within the scope of embodiments encompassed by the disclosure as contemplated by the inventor.

What is claimed is:

1. A helmet-device control system, comprising:

a helmet comprising two straps oriented at an oblique angle to one another and defining a wedge-shaped gap between the two straps; and an accessory structure configured for connection to the two straps of the helmet, the accessory structure comprising a module including a controller configured to send signals to and receive signals from another device, the controller configured to control at least one operation of a speaker, the module comprising:

a first strap engagement structure disposed on a first side of the module, the first strap engagement structure configured for connection to a first strap of the two straps, the first strap engagement structure comprising:

a first surface configured to extend adjacent to and contact a section of the first strap;

a first strap retention member configured to retain the section of the first strap adjacent the first surface;

a first laterally extending surface projecting from the first surface and positioned to abut against a first lateral edge of the first strap to retain the first strap in the first strap engagement structure;

a second laterally extending surface of the module positioned to abut against a second, opposing lateral edge of the first strap to retain the first strap in the first engagement structure; and a first opening between the first surface and the first strap retention member such that the first strap is receivable through the first opening without threading the first strap through the first strap engagement structure;

a second strap engagement structure disposed on a second side of the module, the second strap engagement structure configured for connection to a second strap of the two straps, the second strap engagement structure comprising:

a second surface configured to extend adjacent to and contact a section of the second strap, wherein a centerline of the first surface of the first strap engagement structure is oriented at a fixed oblique angle with respect to a centerline of the second surface of the second strap engagement structure;

a second strap retention member configured to retain the section of the second strap adjacent the second surface;

a third laterally extending surface projecting from the second surface and positioned to abut against a first lateral edge of the second strap to retain the second strap in the second strap engagement structure;

a fourth laterally extending surface of the module positioned to abut against a second, opposing lateral edge of the second strap to retain the second strap in the second engagement structure; and a second opening between the second surface and the second strap retention member such that the second strap is receivable through the second opening without threading the second strap through the second strap engagement structure; and an input device configured to enable user interaction with the module.

2. The system of claim 1, wherein the first strap and the second strap extend from different fixed attachment locations on the helmet and converge with one another at an adjustable connector.

3. The system of claim 2, wherein the first strap is placed in tension against the first strap retention member and the second strap is placed in tension against the second strap retention member when the accessory structure is connected to the two straps of the helmet.

4. The system of claim 1, wherein the controller of the accessory structure is further configured to control at least one operation of a microphone.

5. The system of claim 1, further comprising a first grip pad of high-friction material defining the first surface of the first strap engagement structure and a second grip pad of high-friction material defining the second surface of the second strap engagement structure.

6. The system of claim 1, wherein a shortest distance between the first strap retention member and the second strap retention member is between about 4 in (10.16 cm) and about 2 in (5.08 cm).

7. The system of claim 1, wherein the first strap retention member comprises a portion extending over at least a portion of the first surface, and wherein the second strap retention member comprises a portion extending over at least a portion of the second surface.

8. The system of claim 1, wherein the longitudinal centerline of the first surface is oriented at between about 55° and about 75° relative to the longitudinal centerline of the second surface.

9. The system of claim 8, wherein the longitudinal centerline of the first surface is oriented at about 65° relative to the longitudinal centerline of the second surface.

10. The system of claim 1, wherein the input device of the module comprises at least one button configured to enable a user to cause the speaker to at least one of play an audio signal, pause an audio signal, increase volume of an audio signal, and decrease volume of an audio signal.

* * * * *